US007381071B2

(12) United States Patent
Hayashi

(10) Patent No.: US 7,381,071 B2
(45) Date of Patent: Jun. 3, 2008

(54) FLOATING ELECTRICAL CONNECTOR WITH TWISTED CONTACTS

(75) Inventor: Toshiaki Hayashi, Aichi (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/622,030

(22) Filed: Jan. 11, 2007

(65) Prior Publication Data

US 2007/0173096 A1 Jul. 26, 2007

(30) Foreign Application Priority Data

Jan. 23, 2006 (JP) ..... 2006-013672

(51) Int. Cl.
*H01R 13/64* (2006.01)

(52) U.S. Cl. ..... 439/246; 439/247

(58) Field of Classification Search ..... 439/246, 439/247, 83, 474

See application file for complete search history.

(56) References Cited

U.S. PATENT DOCUMENTS 4,917,614 A 4/1990 Kikuchi et al.
6,908,326 B2 * 6/2005 Shiota et al. ..... 439/247
6,932,619 B2 * 8/2005 Chen ..... 439/66

FOREIGN PATENT DOCUMENTS

JP 63-285880 11/1988
JP 2005-317263 11/2005

* cited by examiner

*Primary Examiner*—Renee S Luebke
*Assistant Examiner*—Vanessa Girardi
(74) *Attorney, Agent, or Firm*—Barley Snyder LLC

(57) ABSTRACT

An electrical connector includes a fixed housing, a moveable housing, and a plurality of contacts. The fixed housing is attached to the moveable housing such that the moveable housing is moveable with respect to the fixed housing. Each of the contacts has a connecting member, a female contact member, and a flexible linking member extending there between. The connecting member is fastened to the fixed housing. The female contact member is fastened to the moveable housing. The flexible linking member is twisted about 45 degrees relative to a direction of contact pressure applied to the female contact member by a mating male contact.

15 Claims, 11 Drawing Sheets

FLOATING ELECTRICAL CONNECTOR WITH TWISTED CONTACTS

CROSS-REFERENCE TO RELATED APPLICATIONS

This application claims the benefit of the filing date under 35 U.S.C. § 119(a)-(d) of Japanese Patent Application No. 2006-013672, filed on Jan. 23, 2006.

FIELD OF THE INVENTION

The present invention relates to an electrical connector that compensates for deviation in a mating position with a mating connector.

BACKGROUND

An example of a conventional electrical connector that compensates for deviation in a mating position with a mating connector is shown in FIGS. 10A-10C (see JP 2005-317263A). This type of electrical connector is commonly referred to as a floating-type electrical connector. As shown in FIGS. 10A-10C, the electrical connector 101 comprises a first housing 110 mounted on a circuit board (not shown), a second housing 120 positioned above the first housing 110, and a plurality of contacts 130. Each of the contacts 130 comprises a connecting member 131, a contact member 132, and a flexible linking member 133. The connecting member 131 is fastened to the first housing 110 and connected to the circuit board (not shown). The contact member 132 is fastened to the second housing 120 and contacts a mating contact 151 of a mating connector 150. The flexible linking member 133 connects the connecting member 131 and contact member 132. The connecting member 131 and the flexible linking member 133 extend in a direction Z. The contact member 132 extends in a direction Y perpendicular to a direction of a length of the first and second housings 110, 120. The flexible linking member 133 has a bent member that is bent in the direction Y perpendicular to the direction of a length of the first and second housings 110, 120. The bent member enables movement of the contact member 132 with respect to the connecting member 131.

The first housing 110 includes a pair of circuit board positioning posts 111. The circuit board positioning posts 111 pass through the first housing 110, protrude upward, and enter recessed members 121 formed in the second housing 120. The recessed members 121 have an inner diameter greater than an outer diameter of the circuit board positioning posts 111 so that the circuit board positioning posts 111 are loosely inserted into the recessed members 121, assuming a state in which relative movement of the circuit board positioning posts 111 is allowed. Accordingly, the second housing 120, and hence the contact members 132 of the contacts 130 fastened to the second housing 120, can move as a result of the circuit board positioning posts 111 being loosely inserted into the recessed members 121. Movement is also possible in a direction of length of the first housing 110 (direction X), in the direction Y perpendicular to the direction of length of the first and second housings 110, 120, and in the direction Z, because of the bent members of the flexible linking members 133.

As shown in FIG. 10C, the mating connector 150 is designed to mate with the second housing 120 along the direction Y perpendicular to the direction of length of the first and second housings 110, 120. The positional deviation of the mating connector 150 in two mutually perpendicular directions (X direction and Z direction) along a mating surface at the time of mating is absorbed by the second housing 120 having movement in the two mutually perpendicular directions (X direction and Z direction) along the mating surface, while the positional deviation of the mating connector 150 in the direction Y perpendicular to the mating surface is absorbed by the second housing 120 having movement in the direction Y perpendicular to the mating surface.

Although not a floating-type electrical connector, an example of another conventional electrical connector is shown in FIGS. 11-12 (see JP 63-285880A). This electrical connector prevents the application of excessive force to contact members of contacts when positional deviation occurs during mating with a mating connector. As shown in FIG. 11, the electrical connector 201 comprises a housing 210 and a plurality of contacts 220 fastened to the housing 210. The contacts 220 are fastened to a rectangular bottom member 211 of the housing 210. Square side wall members 212 are provided around the bottom member 211. A plurality of openings 213 disposed at an inclination with respect to the side wall members 212 are formed in the bottom member 211 of the housing 210.

As shown in FIG. 12, each of the contacts 220 comprises a contact member 221 having pair of opposing contact pieces 222, a connecting member 223 connected to a circuit board (not shown), and a base member 224 that connects the contact member 221 and the connecting member 223. The connecting member 223 extends so as to have an angle θ with respect to the base member 224 and the contact member 221, as seen in a plan view. As shown in FIG. 11, the contacts 220 are fastened to the bottom member 211 of the housing 210 by fastening the base members 224 to the openings 213. The contacts 220 are designed so that male contacts provided on a mating connector (not shown) contact the pair of contact pieces 222 of the contact members 221.

When the contacts 220 are fastened to the housing 210, the contacts 220 are disposed so that the connecting members 223 of the contacts 220 are parallel to the ends of the side wall members 212, while the contact members 221 are disposed at an angle with respect to the individual side wall members 212. Accordingly, even when positional deviation occurs during mating with a mating connector, the male contacts make contact with and press the contact members 221 of the contacts 220, because this contact always occurs diagonally with respect to the direction of arrangement of the contact members 221. Therefore, the direction of the force generated by the positional deviation is biased with respect to the direction of arrangement of the contact members 221, so that no excessive force is applied to the contact members 221.

Several problems, however, have been encountered in the conventional electrical connector 101 shown in FIGS. 10A-10C and the conventional electrical connector 201 shown in FIGS. 11-12. In the electrical connector 101 shown in FIGS. 10A-10C, although the second housing 120 moves in the two mutually perpendicular directions (X direction and Z direction) along the mating surface, there is a difference in the amount of displacement of the flexible linking members 133 of the respective contacts 130 in the two mutually perpendicular directions (X direction and Z direction) along the mating surface due to the shape of the flexible linking members 133. Thus, there is a problem in that a difference in the amount of absorption of the positional deviation is generated between a case in which the position of the mating connector 150 shifts in the direction X along the mating surface and a case in which the position of the mating connector 150 shifts in the direction Z perpendicular to the direction X along the mating surface. Moreover, there is a difference in the ease of deformation of the flexible linking members 133 in the two mutually perpendicular directions (X direction and Z direction) along the mating surface. Thus, there is a problem in that a difference in the amount of connector mating force is generated between a case in which the position of the mating connector 150 shifts in the direction X along the mating surface and a case in which the position of the mating connector 150 shifts in the direction Z perpendicular to the direction X along the mating surface.

In the electrical connector 201 shown in FIG. 11, the application of excessive force to the contact members 221 of the contacts 220 can be prevented when the mating position of the mating connector shifts. However, because this is not a floating-type electrical connector, it is not possible to absorb the positional deviation when the position of the mating connector shifts in a direction along the mating surface during mating.

BRIEF SUMMARY

The present invention provides an electrical connector comprising a fixed housing, a moveable housing, and a plurality of contacts. The fixed housing is attached to the moveable housing such that the moveable housing is moveable with respect to the fixed housing. Each of the contacts has a connecting member, a female contact member, and a flexible linking member extending there between. The connecting member is fastened to the fixed housing. The female contact member is fastened to the moveable housing. The flexible linking member is twisted about 45 degrees relative to a direction of contact pressure applied to the female contact member by a mating male contact.

The present invention further provides an electrical connector comprising a fixed housing, a moveable housing, and a plurality of contacts. The fixed housing is attached to the moveable housing such that the moveable housing is moveable with respect to the fixed housing. Each of the contacts has a connecting member, a female contact member, and a flexible linking member extending there between. The connecting member is fastened to the fixed housing. The female contact member is fastened to the moveable housing. The flexible linking member is positioned at an inclination of about 45 degrees with respect to a direction of length of a side of the moveable housing.

DETAILED DESCRIPTION OF THE EMBODIMENT(S)

Figure 1:
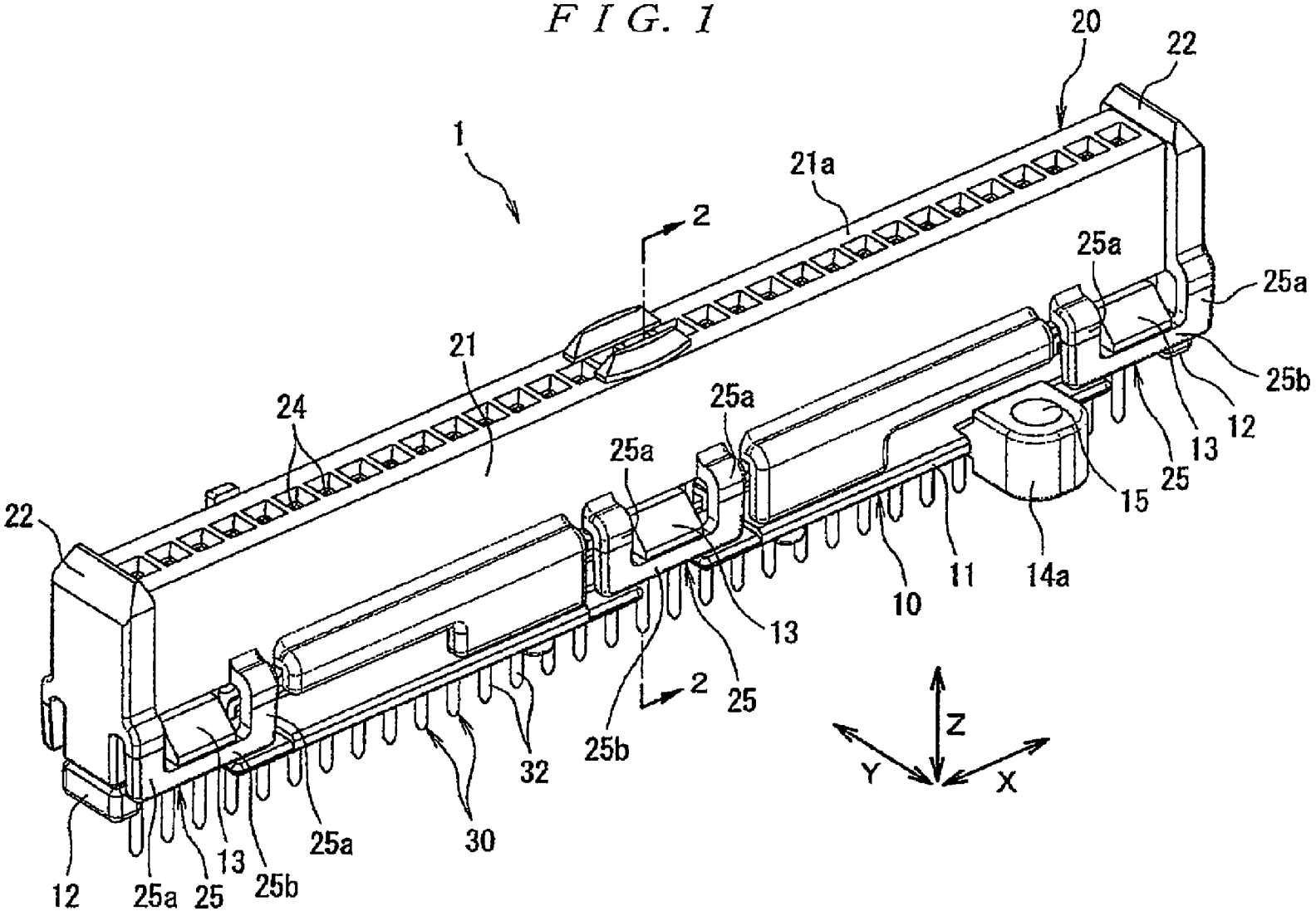
FIG. 1 is a perspective view of an electrical connector according to the present invention.

FIGS. 1-6 show an electrical connector 1 according to the invention. As shown in FIG. 1, the electrical connector 1 comprises a fixed housing 10 fastened to a surface of a circuit board PCB (FIG. 3), a movable housing 20 capable of moving with respect to the fixed housing 10, and a plurality of contacts 30. The fixed housing 10 and the movable housing 20 may be formed, for example, by molding an insulating resin.

Figure 3:
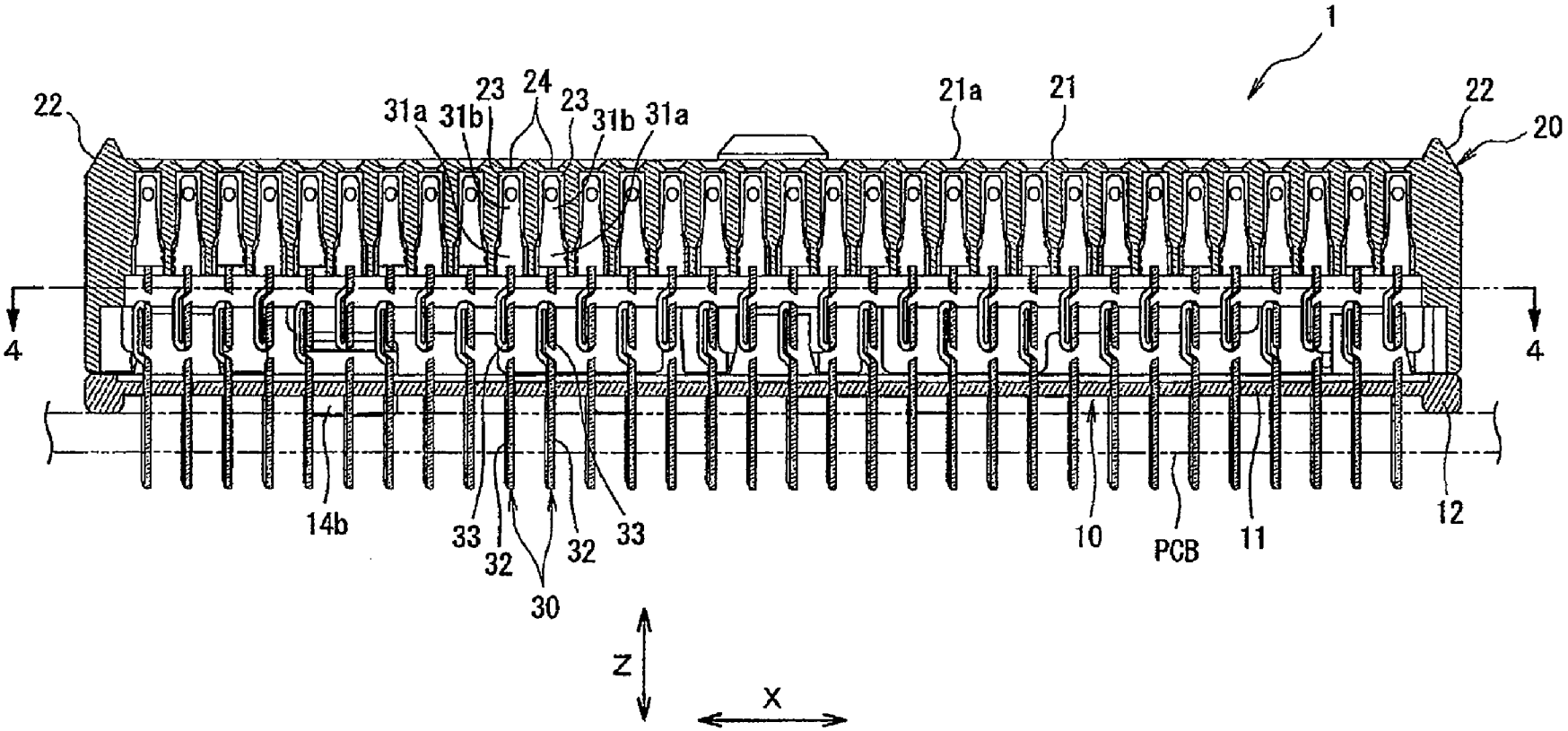
FIG. 3 is a sectional view along line 3-3 in FIG. 2.
Figure 4:
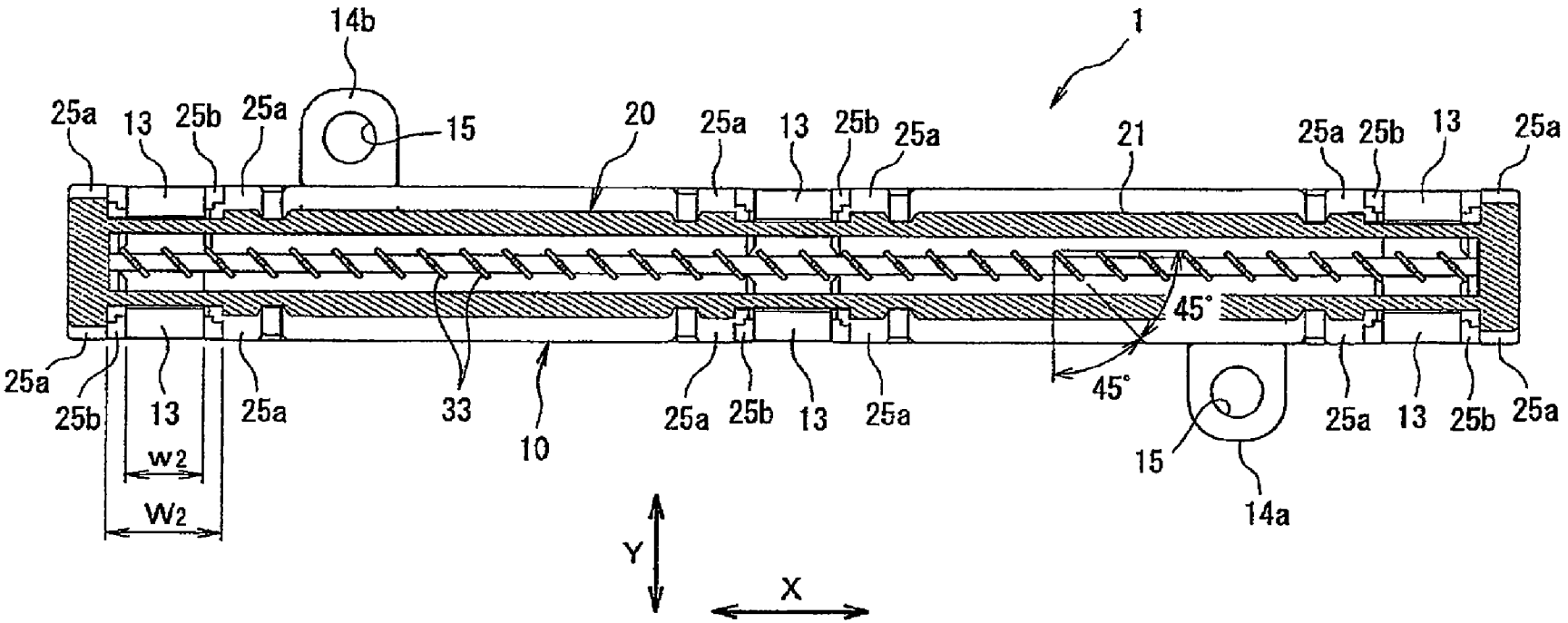
FIG. 4 is a sectional view along line 4-4 in FIG. 3.
Figure 5:
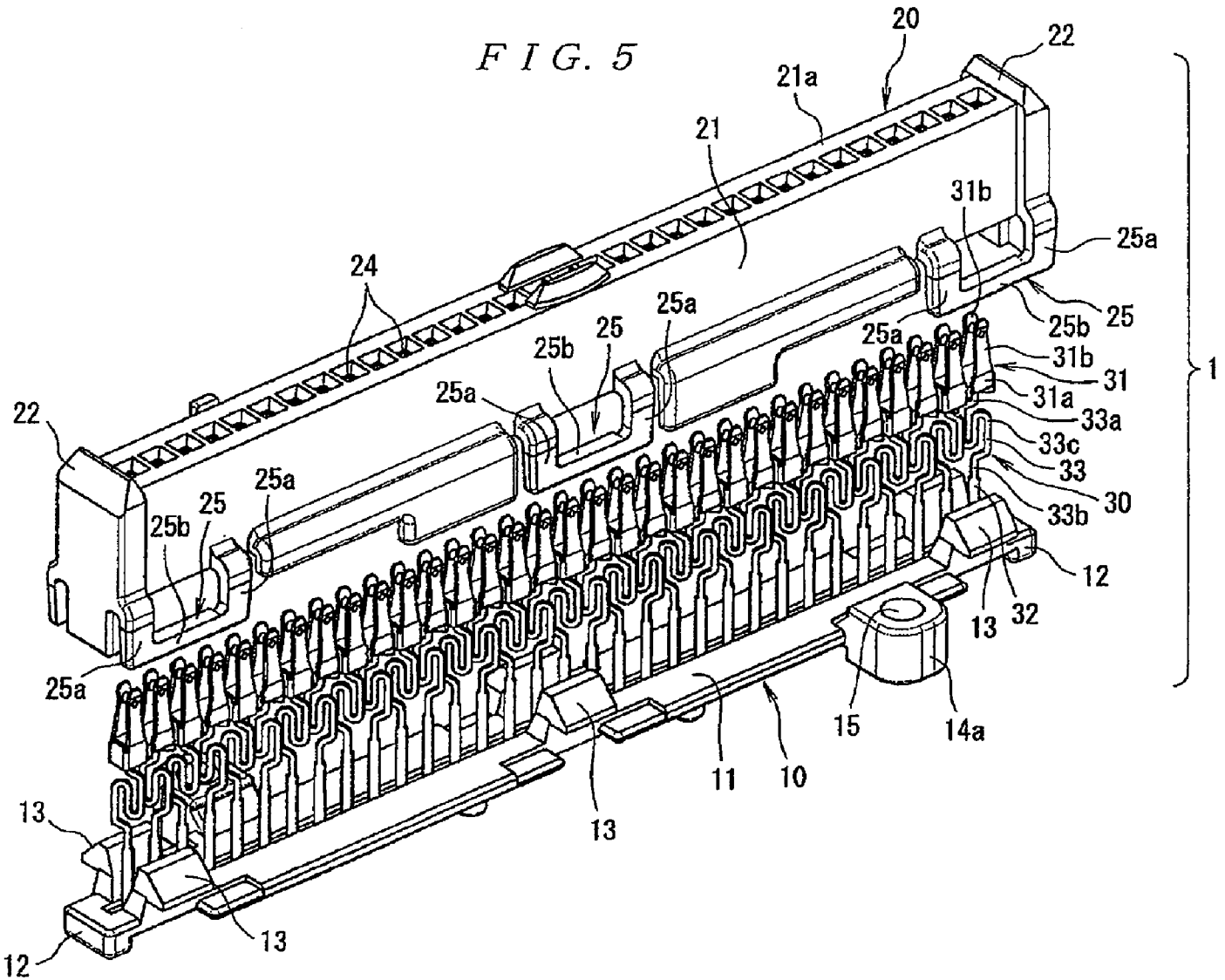
FIG. 5 is a perspective view of the electrical connector shown in FIG. 1 in which a fixed housing to which the contacts are fastened and a movable housing are disassembled.

As shown in FIG. 1, the fixed housing 10 comprises a substantially rectangular base member 11 that extends in a direction of length (direction X). As shown in FIG. 3, a pair of carrying members 12 carried on the circuit board PCB protrude downward from ends of the base member 11 in the direction of length (direction X). A fastening member 14*a* protrudes forward from a front surface (lower surface in FIG. 4) of the base member 11 in a direction of width (direction Y), which is substantially perpendicular to the direction of length (direction X), and a fastening member 14*b* protrudes rearward from a rear surface of the base member 11 in the direction of width (direction Y). As shown in FIG. 4, a through-hole 15 through which a fastening member such as a screw (not shown) for fastening the base member 11 of the fixed housing 10 to the circuit board PCB is inserted is formed in each of the fastening members 14*a*, 14*b*. As shown in FIG. 5, pairs of locking projections 13 protrude upward from an upper surface of the base member 11 in the front end portion and rear end portion with respect to the direction of width (direction Y). The pairs of locking projections 13 are formed in a central portion and in a vicinity of both ends of the base member 11 in the direction of length (direction X). Each of the locking projections 13 has a substantially cross-sectional L shape so as to be locked with a corresponding locking member 25 of the movable housing 20.

Figure 2:
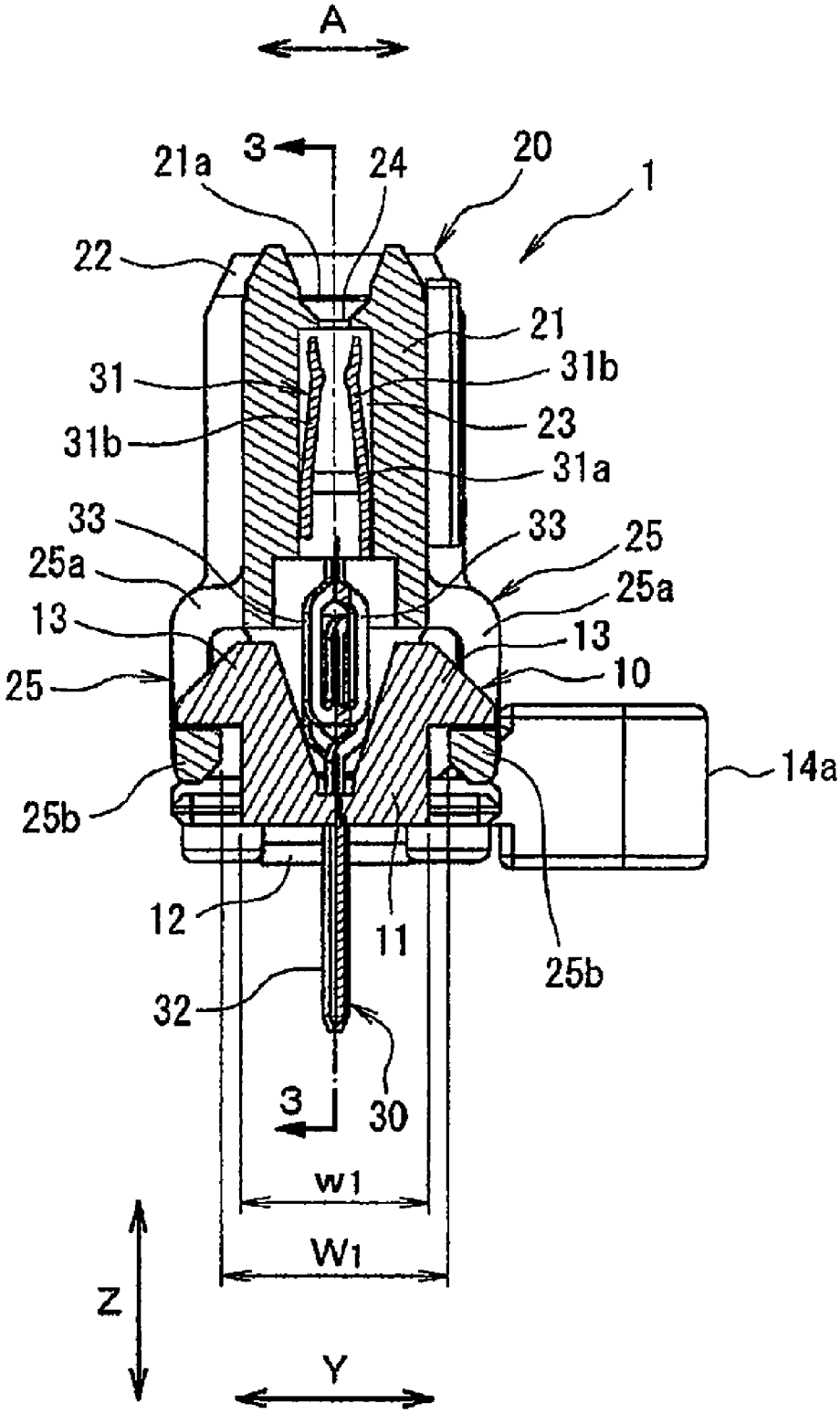
FIG. 2 is a sectional view along line 2-2 in FIG. 1.

As shown in FIG. 5, the movable housing 20 is designed to be attached to the fixed housing 10 from above in a manner that allows movement. The moveable housing 20 comprises a substantially rectangular base member 21 that extends in the direction of length (X direction). The base member 21 is designed so that a mating connector (not shown) mates with the base member 21 from above. An upper surface of the base member 21 forms a mating surface 21*a* with the mating connector (not shown). A pair of mating connector guide members 22 is provided on ends of the base member 21 in the direction of length (direction X). As shown in FIG. 2, a plurality of contact accommodating cavities 23 are formed in the base member 21 along the direction of length (direction X). An opening 24 is formed in an upper surface of each of the contact accommodating cavities 23, so that mating male contacts (not shown) provided on the mating connector (not shown) are inserted into the contact accommodating cavities 23 through the openings 24. The pairs of locking members 25 are provided on a front surface and rear surface of the base member 21 in the direction of width (direction Y). Each of the locking members 25 provided on the front surface of the base member 21 comprises a pair of leg members 25*a* that first extend forward from the front surface of the base member 21 and then extend downward. A linking member 25*b* connects bottom end portions of the leg members 25*a*. Each of the locking members 25 provided on the rear surface of the base member 21 comprises a pair of leg members 25*a* that first extend rearward from the rear surface of the base member 21 and then extend downward. A linking member 25*b* connects bottom end portions of the leg members 25*a*.

As shown in FIGS. 1-2, when the movable housing 20 is locked with the fixed housing 10, the outward protruding portions of the locking projections 13 of the fixed housing 10 engage with the upper surfaces of the linking members 25*b*. As shown in FIG. 2, a gap W1 between the linking members 25*b* provided on the front surface of the base member 21 in the direction of width (Y direction) and the linking members 25*b* provided on the rear surface of the base member 21 in the direction of width (Y direction) is set to be larger than a width w1 of a base of each pair of locking projections 13 provided on the front end portion and rear end portion of the fixed housing 10 in the direction of width (Y direction). As a result, the movable housing 20 can move in the direction of width (Y direction) with respect to the fixed housing 10. The movement of the movable housing 20 in the direction of width (Y direction) is restricted by the linking members 25*b* of the locking members 25 provided on the front surface of the base member 21 in the direction of width (Y direction) and the linking members 25*b* of the locking members 25 provided on the rear surface of the base member 21 in the direction of width (Y direction) making contact with the base of each pair of the locking projections 13 provided on the front end portion and rear end portion of the fixed housing 10 in the direction of width (Y direction).

As shown in FIG. 2, when the movable housing 20 is locked with the fixed housing 10, a gap is formed between the undersurface of the base member 21 of the movable housing 20 and the upper surfaces of the locking projections 13 of the fixed housing 10. As a result, the movable housing 20 can move in a vertical direction (Z direction) with respect to the fixed housing 10. The downward movement of the movable housing 20 is restricted by the undersurface of the base member 21 of the movable housing 20 contacting the upper surfaces of the locking projections 13 of the fixed housing 10, and the upward movement of the movable housing 20 is restricted by the linking members 25*b* of the locking members 25 of the movable housing 20 contacting the locking projections 13 of the fixed housing 10.

As shown in FIG. 4, a gap W2 between the leg members 25*a* in each pair is set to be larger than a width w2 of the locking projections 13 provided on the fixed housing 10. As a result, the movable housing 20 can move in the direction of length (X direction) with respect to the fixed housing 10. The movement of the movable housing 20 in the direction of length (X direction) is restricted by the respective leg members 25*a* of the movable housing 20 contacting the locking projections 13 provided on the fixed housing 10.

Figure 7A:
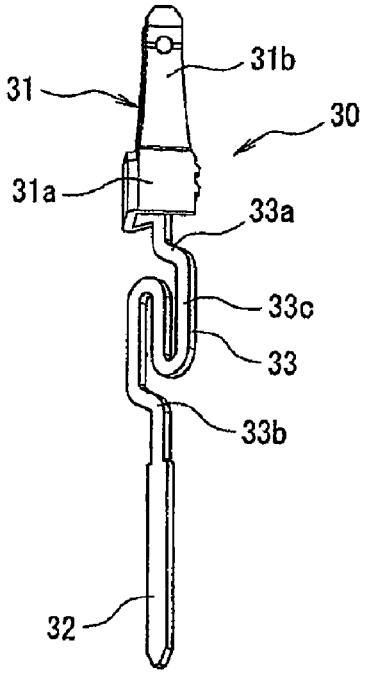
FIG. 7A is a front view of a contact.
Figure 7C:
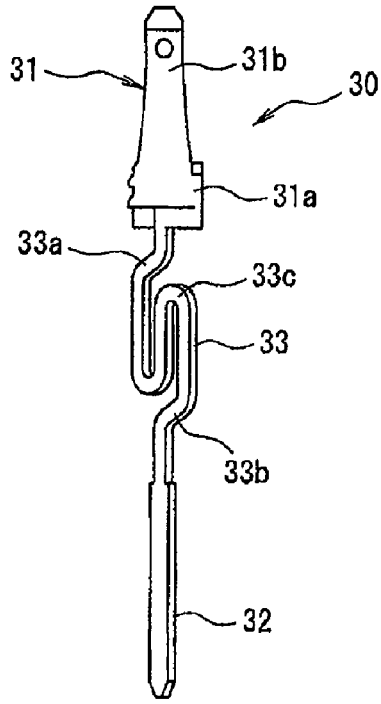
FIG. 7C is a back view of the contact of FIG. 7A.
Figure 7B:
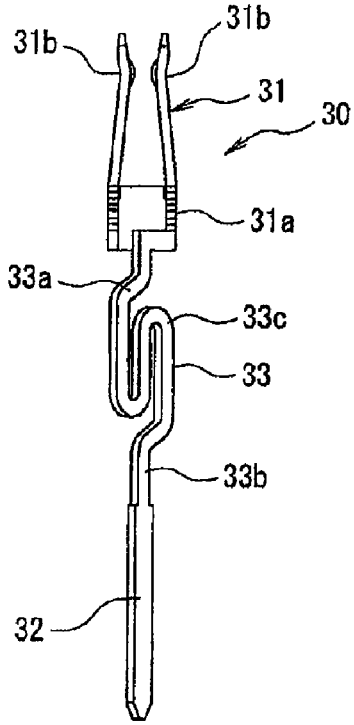
FIG. 7B is a right-side view of the contact of FIG. 7A.
Figure 7D:
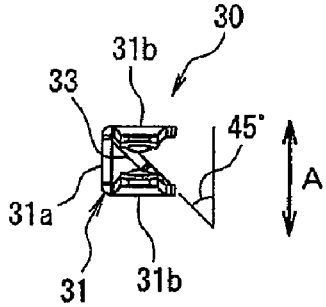
FIG. 7D is a plan view of the contact of FIG. 7A.
Figure 7E:
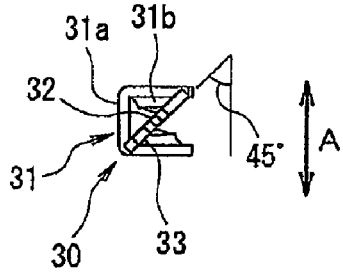
FIG. 7E is a bottom view of the contact of FIG. 7A.

As shown in FIGS. 7A-7E, each of the contacts 30 comprises a female contact member 31 provided on an upper end, a connecting member 32 provided on a lower end, and a flexible linking member 33 that connects the female contact member 31 and connecting member 32. Each of the contacts 30 may be formed, for example, by stamping and forming a metal plate. The female contact member 31 of each of the contacts 30 comprises a housing fastening member 31*a* that has a substantially C-shaped cross-section as seen from above, and a pair of elastic contact pieces 31*b* that extend upward from opposing side walls of the housing fastening member 31*a*, as shown in FIG. 7D. Because of the presence of the flexible linking member 33, movement of the female contact member 31 is possible with respect to the connecting member 32 in the direction of length (X direction), direction of width (Y direction), and vertical direction (Z direction). The housing fastening member 31*a* of the female contact member 31 is designed to be fastened to the corresponding contact accommodating cavity 23 in the movable housing 20. The mating male contacts (not shown) are received between each of the corresponding elastic contact pieces 31*b* to establish electrical contact there between.

Each of the connecting members 32 is designed to be fastened to the base member 11 of the fixed housing 10 and connected by soldering to the circuit board PCB. The connecting members 32 are fastened in a single row along the direction of length (X direction) of the base member 11. The flexible linking member 33 and the connecting member 32 of each of the contacts 30 are twisted about 45 degrees relative to a direction of contact pressure (direction of arrow A in FIGS. 7D and 7E) generated when the mating male contact (not shown) is received between the elastic contact pieces 31*b*. Each of the flexible linking members 33 comprises an upper member 33*a* that extends downward from a lower end of one of the opposing side walls of the housing fastening member 31*a* of the female contact member 31 and further extends downward at an inclination. A lower member 33*b* extends upward from an upper end of the connecting member 32 and further extends upward at an inclination. A substantially S-shaped bent member 33*c* extends between a lower end of the upper member 33*a* and the lower member 33*b*.

Figure 6:
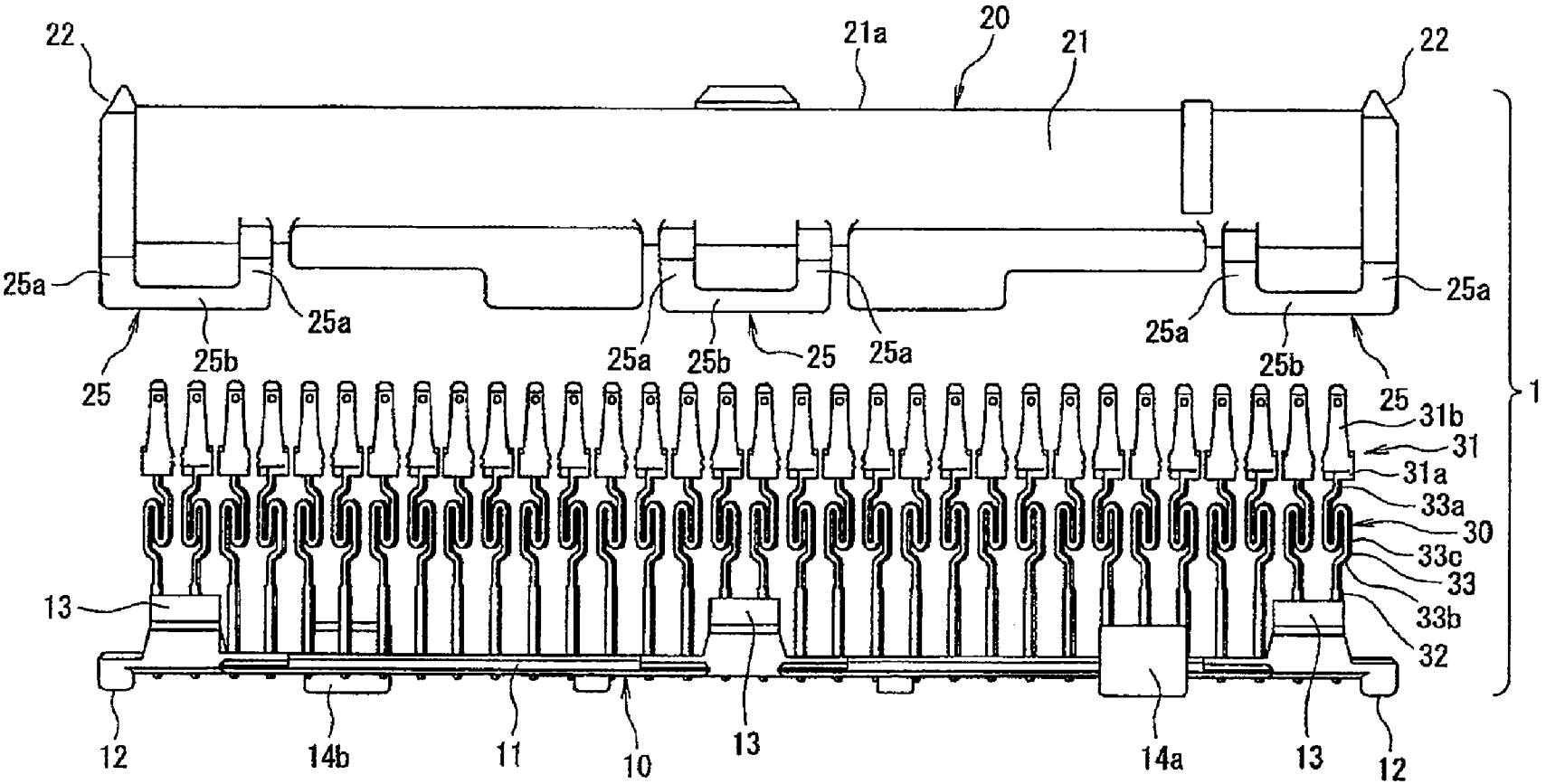
FIG. 6 is a front view of the electrical connector shown in FIG. 1 in which a fixed housing to which the contacts are fastened and a movable housing are disassembled.

As shown in FIG. 2, the housing fastening members 31*a* of the female contact members 31 of the individual contacts 30 are respectively fastened to the contact accommodating cavities 23 in the movable housing 20 so that the direction of contact pressure (direction of arrow A) generated when the mating male contacts (not shown) are received between the elastic contact pieces 31*b* is substantially perpendicular to a direction of length (X direction) of one side of the movable housing 20. Because the flexible linking members 33 are twisted about 45 degrees relative to the direction of contact pressure (direction of arrow A) generated when the mating male contacts (not shown) are received between the elastic contact pieces 31*b*, the flexible linking members 33 of the contacts 30 are disposed at an inclination of about 45 degrees with respect to the direction of length (X direction) of one side of the movable housing 20. As shown in FIGS. 5-6, the connecting members 32 of the plurality of contacts 30 are fastened at an inclination of about 45 degrees with respect to the direction of length (X direction) of one side of the fixed housing 10.

In the electrical connector 1, movement of the movable housing 20 is made possible in the direction of width (Y direction) with respect to the fixed housing 10 because the gap W1 between the linking members 25*b* provided on the front surface of the base member 21 in the direction of width and the linking members 25*b* of the locking members 25 provided on the rear surface of the base member 21 in the direction of width (Y direction) is set to be larger than the width w1 of the base of each pair of the locking projections 13 provided on the front end portion and rear end portion of the fixed housing 10 in the direction of width (Y direction), and also because of the presence of the flexible linking members 33 of the respective contacts 30. Movement of the movable housing 20 is made possible in the direction of length (X direction) with respect to the fixed housing 10 because the gap W2 between the leg members 25*a* in each pair is set to be larger than the width w2 of the locking projections 13 provided on the fixed housing 10, and also because of the presence of the flexible linking members 33 of the respective contacts 30. Movement of the movable housing 20 is made possible in the vertical direction (Z direction) with respect to the fixed housing 10 because a gap is provided between the undersurface of the base member 21 of the movable housing 20 and the upper surfaces of the locking projections 13 of the fixed housing 10, and also because of the presence of the flexible linking members 33 of the respective contacts 30.

When the mating connector (not shown) is caused to mate with the base member 21 of the movable housing 20 downward from above (in the Z direction), the mating male contacts (not shown) are received by and make contact with the female contact members 31 of the contacts 30. The positional deviation of the mating connector (not shown) in the two mutually substantially perpendicular directions (X direction and Y direction) along the mating surface 21*a* of the base member 21 during this mating is absorbed by the movement of the movable housing 20 in the two mutually substantially perpendicular directions (X direction and Y direction) along the mating surface 21*a*, while the positional deviation of the mating connector in the direction (Z direction) substantially perpendicular to the mating surface 21*a* is absorbed by the movement of the movable housing 20 in the direction (Z direction) substantially perpendicular to the mating surface 21*a*.

With regard to each of the contacts 30, because the flexible linking member 33 is disposed at an inclination of about 45 degrees with respect to the direction of length (X direction) of one side of the movable housing 20, the flexible linking member 33 of each of the contacts 30 elastically deforms in the same manner in the two mutually substantially perpendicular directions (X direction and Y direction) along the mating surface 21*a*, so that there is no difference in the amount of displacement or the ease of deformation of the flexible linking member 33 in the two mutually substantially perpendicular directions along the mating surface 21*a*. As a result, it is possible to obtain a floating-type electrical connector 1 where there is no generation of any difference in the amount of absorption of the positional deviation between a case in which the position of the mating connector (not shown) shifts in one direction (X direction) along the mating surface 21*a* and a case in which the position of the mating connector shifts in a direction (Y direction) substantially perpendicular to this one direction (X-direction) along the mating surface 21*a*.

Figure 8:
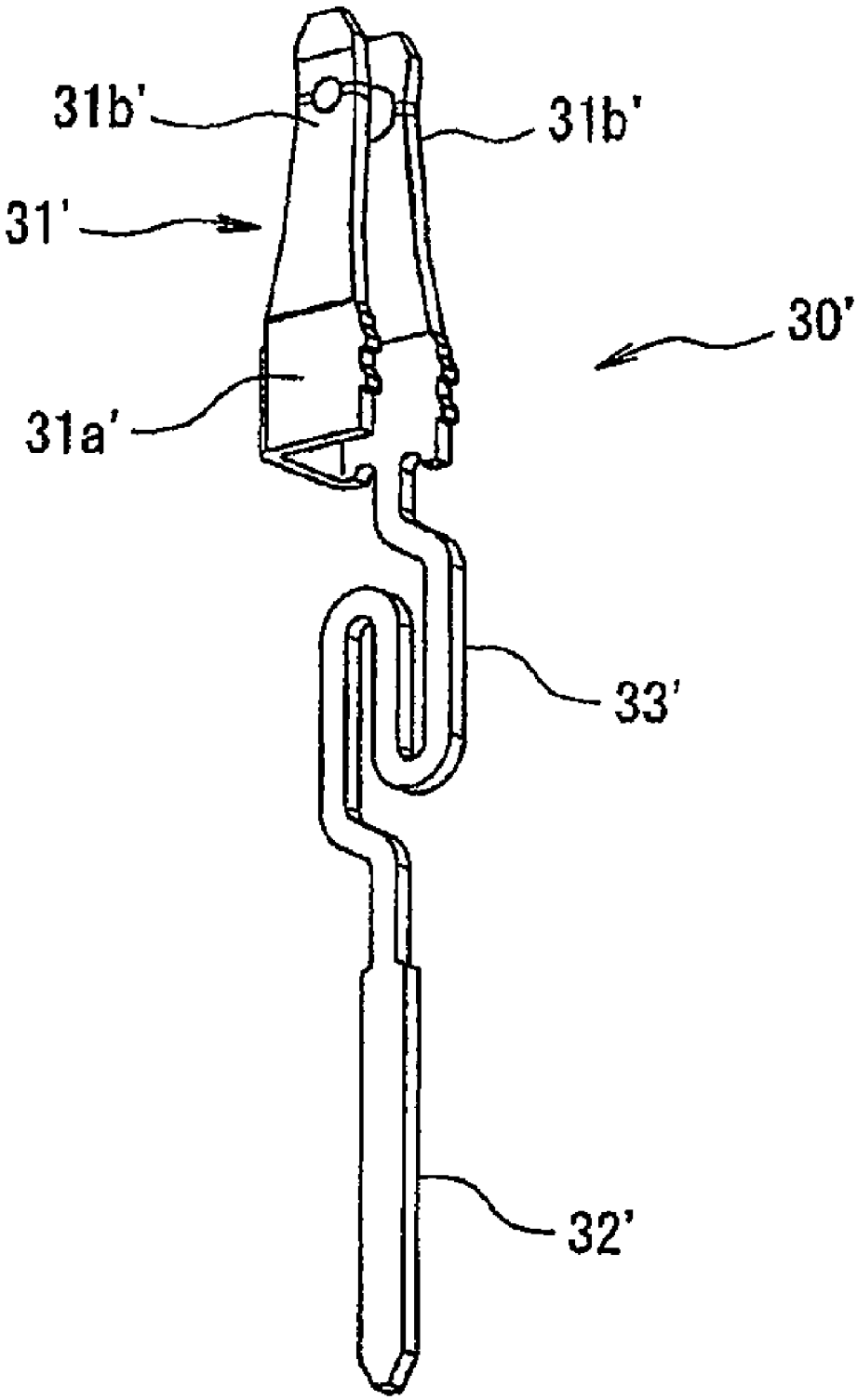
FIG. 8 is a perspective view of another contact.

FIG. 8 shows an example of another contact 30'. As shown in FIG. 8, the contact 30' comprises a female contact member 31' provided on an upper end, a connecting member 32' provided on a lower end, and a flexible linking member 33' that connects the female contact member 31' and the connecting member 32'. Unlike the flexible linking member 33 and the connecting member 32 of the contacts 30, the flexible linking member 33' and the connecting member 32' of the contact 30' are not twisted about 45 degrees relative to the direction of contact pressure (direction of arrow A) generated when the mating male contacts (not shown) are received between the elastic contact pieces 31*b*', and therefore extend straight from a lower end of one of the opposing side walls of the housing fastening member 31*a*' of the female contact member 31'.

Figures 9A, 9B:
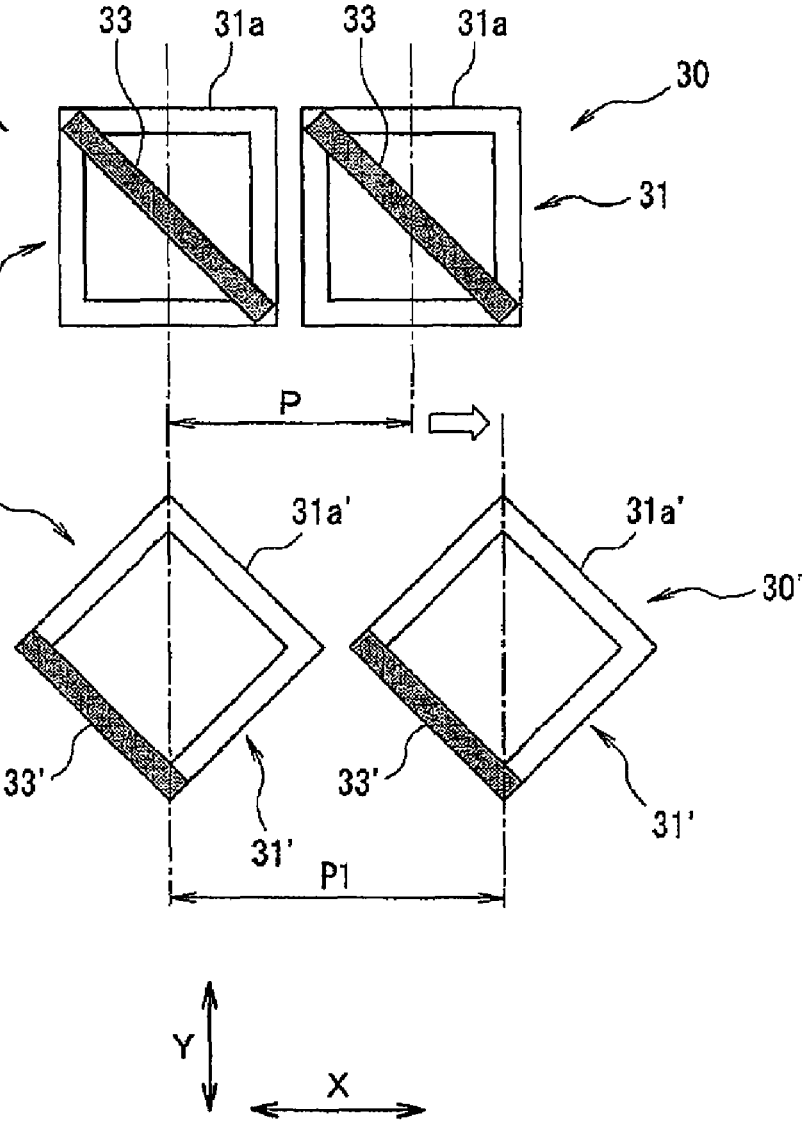
FIG. 9A is a schematic diagram showing a contact pitch of the contacts of FIG. 7A fastened to the movable housing.
FIG. 9B is a schematic diagram showing a contact pitch of the contacts of FIG. 8 fastened to the movable housing.
Figure 10A:
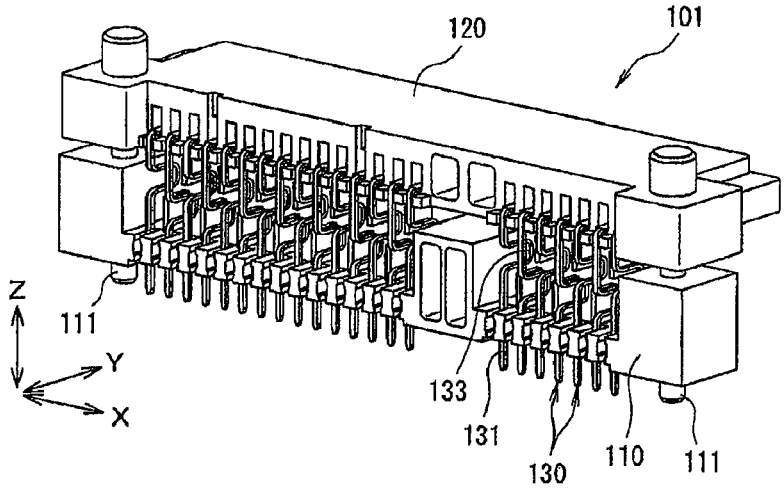
FIG. 10A PRIOR ART
FIG. 10A is a back perspective view of a conventional electrical connector.
Figure 10B:
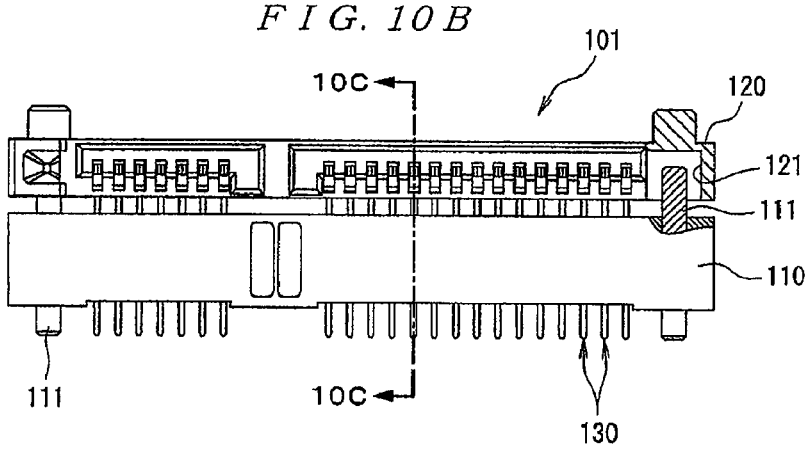
FIG. 10B PRIOR ART
FIG. 10B is a partial front cut-away view of the electrical connector of FIG. 10A.
Figure 10C:
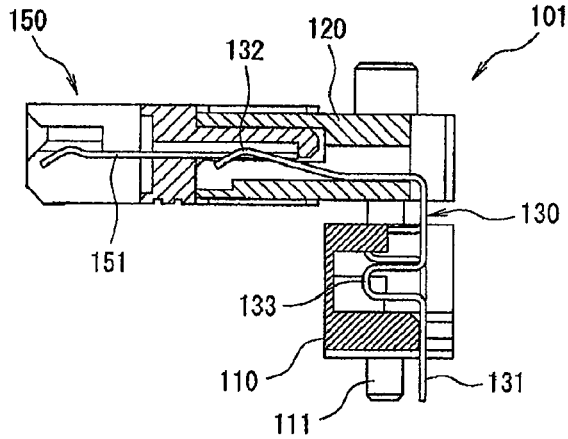
FIG. 10C PRIOR ART
FIG. 10C is a sectional view along line 10C-10C in FIG. 10B.
Figure 11:
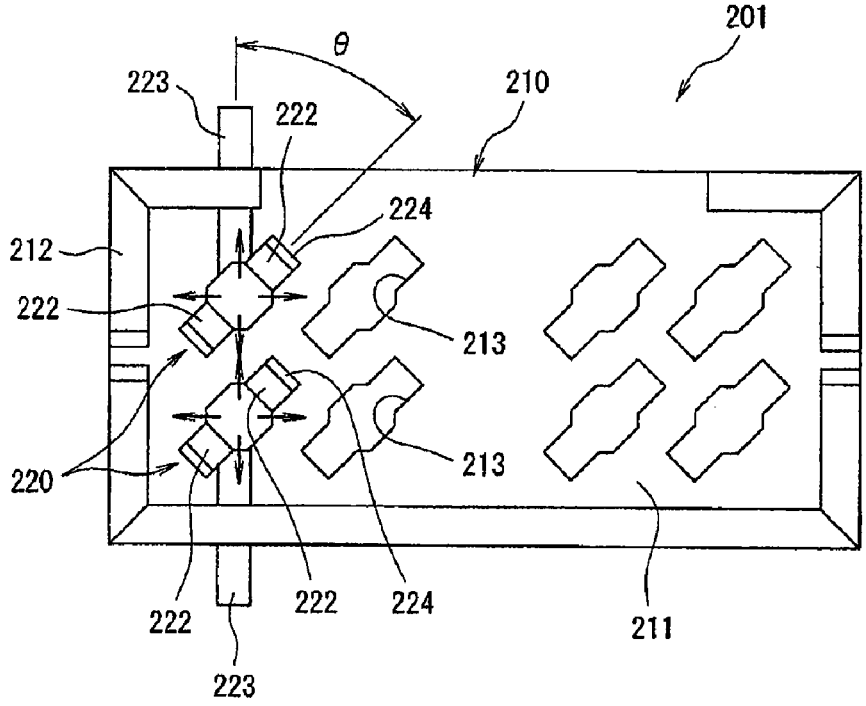
FIG. 11 PRIOR ART
FIG. 11 is a plan view of another conventional electrical connector.
Figure 12:
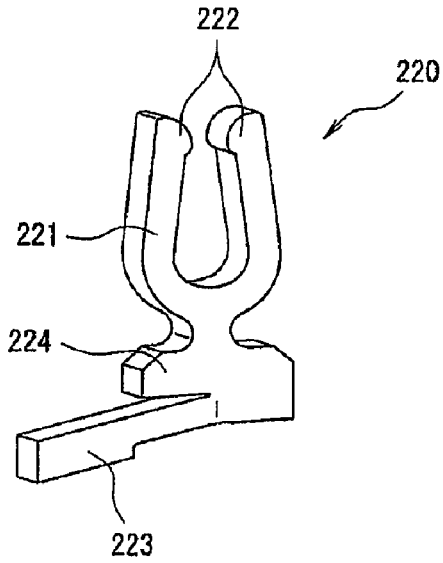
FIG. 12 PRIOR ART
FIG. 12 is a perspective view of a contact of the electrical connector of FIG. 11.

In order to prevent the generation of any difference in the amount of displacement and the ease of deformation of the flexible linking members 33' in the two mutually substantially perpendicular directions (X direction and Y direction) along the mating surface 21*a* in cases where the contacts 30' shown in FIG. 8 are used, it is necessary to position the flexible linking members 33' at an inclination of about 45 degrees relative to the direction of length (X direction) of one side of the movable housing 20, as shown in FIG. 9B. Therefore, it is necessary to dispose the housing fastening members 31*a*' having a substantially cross-sectional C shape so that the direction of contact pressure of the female contact members 31' is tilted about 45 degrees relative to the direction of length (X direction) of one side of the movable housing 20. If this is done, a contact pitch between adjacent contacts 30' is increased to P1 from P compared to the state shown in FIG. 9A in which the contacts 30 are fastened to the movable housing 20.

Accordingly, in the present embodiment, the flexible linking members 33 of the contacts 30 are twisted about 45 degrees relative to the direction of contact pressure (direction of arrow A) of the female contact members 31, and the female contact members 31 are disposed so that the direction of contact pressure (direction of arrow A) of the female contact members 31 is substantially perpendicular to the direction of length (X direction) of one side of the movable housing 20, thus achieving high-density arrangement of the contacts 30 while avoiding interference between the flexible linking members 33 of adjacent contacts 30.

The foregoing illustrates some of the possibilities for practicing the invention. Many other embodiments are possible within the scope and spirit of the invention. For example, the female contact members 31 described and shown as being disposed so that the direction of contact pressure (direction of arrow A) of the female contact members 31 is substantially perpendicular to the direction of length (X direction) of one side of the movable housing 20. However, it would also be possible to dispose the female contact members 31 so that the direction of contact pressure (direction of arrow A) of the female contact members 31 is substantially parallel to the direction of extension (X direction) of one side of the movable housing 20. Furthermore, the fixed housing 10 may be fastened to a housing or the like instead of the circuit board PCB. It is, therefore, intended that the foregoing description be regarded as illustrative rather than limiting, and that the scope of the invention is given by the appended claims together with their full range of equivalents.

What is claimed is:

1. An electrical connector, comprising:

a fixed housing;

a moveable housing attached to the fixed housing, the moveable housing being moveable with respect to the fixed housing; and a plurality of contacts, each of the contacts having a connecting member, a female contact member, and a flexible linking member extending there between; the connecting member being fastened to the fixed housing, the female contact member being fastened to the moveable housing, and the flexible linking member being twisted about 45 degrees relative to a direction of contact pressure applied to the female contact member by a mating male contact.

2. The electrical connector of claim 1, wherein the female contact member is disposed so that the direction of contact pressure is substantially parallel or perpendicular to a direction of length of a side of the moveable housing.

3. The electrical connector of claim 1, wherein the flexible linking member includes a substantially S-shaped bent member.

4. The electrical connector of claim 1, wherein the connecting members are twisted about 45 degrees relative to the direction of contact pressure applied to the female contact member by the mating male contact.

5. The electrical connector of claim 4, wherein the connecting members are fastened to the fixed housing at an inclination of about 45 degrees with respect to the direction of length of a side of the moveable housing.

6. The electrical connector of claim 1, wherein the female contact member includes a housing fastening member having a substantially C-shaped cross-section.

7. The electrical connector of claim 6, wherein the female contact member includes a pair of elastic contact pieces that extend upward from opposing side walls of the housing fastening member.

8. An electrical connector, comprising:

a fixed housing;

a moveable housing attached to the fixed housing, the moveable housing being moveable with respect to the fixed housing; and a plurality of contacts, each of the contacts having a connecting member, a female contact member, and a flexible linking member extending there between; the connecting member being fastened to the fixed housing, the female contact member being fastened to the moveable housing, and the flexible linking member being positioned at an inclination of about 45 degrees with respect to a direction of length of a side of the moveable housing.

9. The electrical connector of claim 8, wherein the female contact member is disposed so that a direction of contact pressure applied to the female contact member by a mating male contact is at about 45 degrees relative to the direction of length of the side of the moveable housing.

10. The electrical connector of claim 8, wherein the female contact member is disposed so that a direction of contact pressure applied to the female contact member by a mating male contact is substantially parallel or perpendicular to the direction of length of the side of the moveable housing.

11. The electrical connector of claim 8, wherein the flexible linking member includes a substantially S-shaped bent member.

12. The electrical connector of claim 8, wherein the flexible linking member is twisted about 45 degrees relative to a direction of contact pressure applied to the female contact member by a mating male contact.

13. The electrical connector of claim 12, wherein the connecting members are twisted about 45 degrees relative to the direction of contact pressure applied to the female contact member by the mating male contact.

14. The electrical connector of claim 8, wherein the female contact member includes a housing fastening member having a substantially C-shaped cross-section.

15. The electrical connector of claim 14, wherein the female contact member includes a pair of elastic contact pieces that extend upward from opposing side walls of the housing fastening member.

* * * * *